US005741867A

United States Patent [19]

Reinehr et al.

[11] Patent Number: 5,741,867

[45] Date of Patent: Apr. 21, 1998

[54] PROCESS FOR ADJUSTING THE VISCOSITY OF HIGHLY CONCENTRATED ELASTANE SOLUTIONS FOR THE DRY SPINNING OR WET SPINNING OF ELASTANE FIBRES

[75] Inventors: Ulrich Reinehr; Günter Türck, both of Dormagen; Tilo Sehm, Düsseldorf; Wolfgang Anderheggen; Toni Herbertz, both of Dormagen, all of Germany; Gino Antolini, Bergamo, Italy

[73] Assignee: Bayer Faser GmbH, Dormagen, Germany

[21] Appl. No.: 677,995

[22] Filed: Jan. 10, 1996

Related U.S. Application Data

[63] Continuation of Ser. No. 573,704, Dec. 18, 1995, abandoned.

[30] Foreign Application Priority Data

Dec. 23, 1994 [DE] Germany ..... 44 46 339.1

[51] Int. Cl.[6] ..... C08F 283/04

[52] U.S. Cl. ..... 525/453; 525/459; 525/460; 528/49; 528/61

[58] Field of Search ..... 525/453, 459, 525/460; 528/49, 61

[56] References Cited

U.S. PATENT DOCUMENTS

| | | | |
|---|---|---|---|
| 5,032,664 | 7/1991 | Frauendorf et al. | 528/49 |
| 5,061,426 | 10/1991 | Frauendorf et al. | 528/52 |
| 5,267,430 | 12/1993 | Payen | 57/6 |
| 5,302,660 | 4/1994 | Klinksiek et al. | 524/871 |

FOREIGN PATENT DOCUMENTS 4222772 1/1994 Germany .

*Primary Examiner*—Morton Foelak

*Attorney, Agent, or Firm*—Sprung Kramer Schaefer & Briscoe

[57] ABSTRACT

The invention relates to a process for adjusting the viscosity of highly concentrated elastane solutions by reaction of the solution with secondary aromatic amines in order to produce spinning solutions for the dry or wet spinning of elastane fibres.

7 Claims, 1 Drawing Sheet

Figure 1:
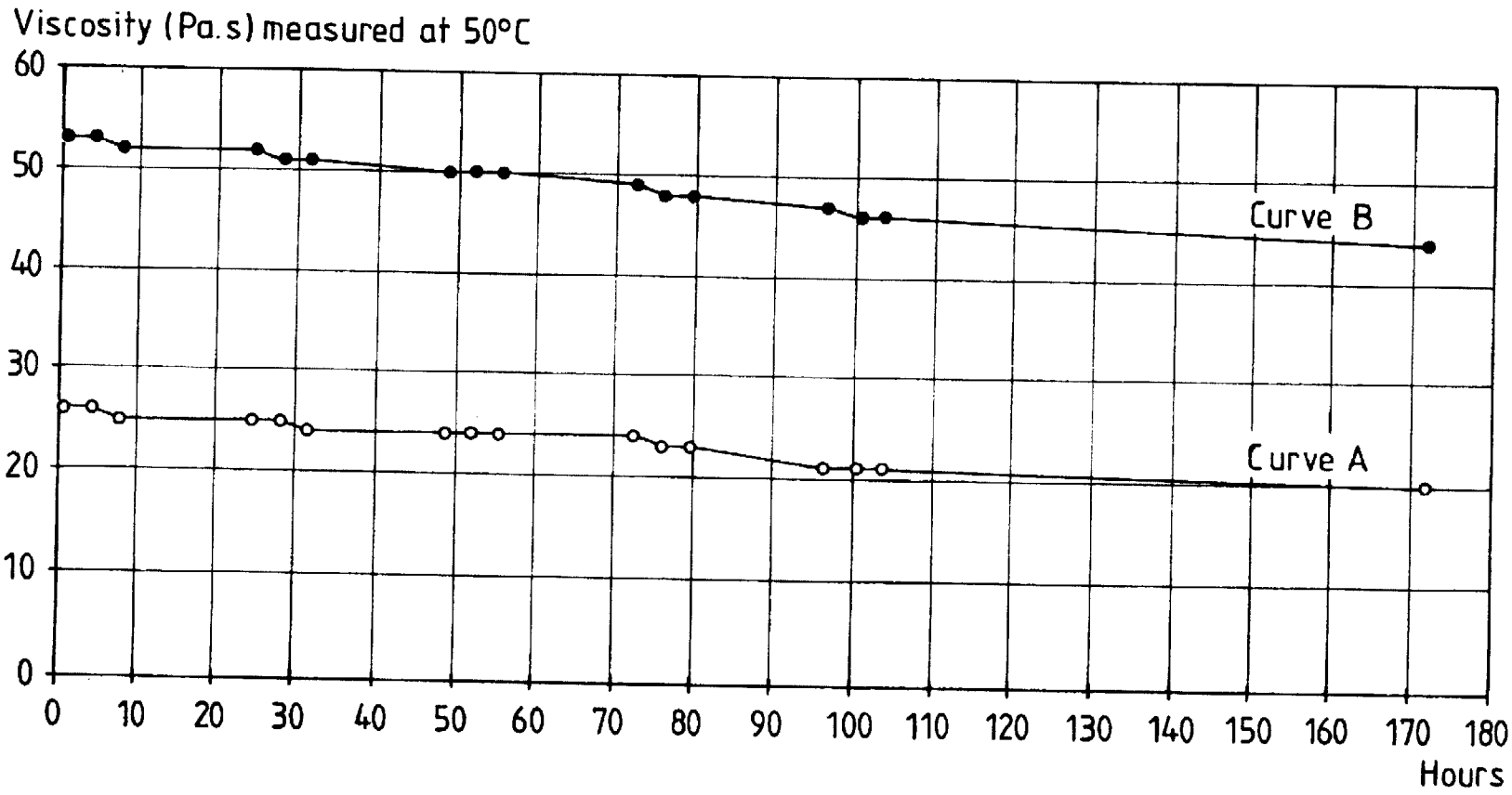

PROCESS FOR ADJUSTING THE VISCOSITY OF HIGHLY CONCENTRATED ELASTANE SOLUTIONS FOR THE DRY SPINNING OR WET SPINNING OF ELASTANE FIBRES

This application is a continuation of Application Ser. No. 08/573,704, filed on Dec. 18, 1995, now abandoned.

The invention relates to a process for modifying or adjusting the viscosity of highly concentrated elastane solutions for the provision of highly concentrated, stable-viscosity elastane spinning solutions for a dry or wet spinning process for the production of elastane fibres.

Elastane solutions mean solutions of polyurethanes or polyurethane ureas which usually have a segmented structure with hard and soft segments in suitable solvents such as dimethylacetamide or dimethylformamide. The soft segments incorporated in the polyurethane (ureas) are usually polyester or polyether chains, depending on the field of application.

Whereas elastane solutions for the dry spinning process may generally have a solids concentration of up to 40 wt. % and above (compare e.g. German specification DE 42 22 772), the corresponding concentration for ready-to-spin solutions for wet spinning is usually in the region of 20 to 25 wt. % (compare F. Fourné, Chemiefasern/Textilindustrie 44/96, June 1994, page 394). The reason for this is the different viscosity required of the spinning solution that is needed to obtain suitable filament properties. For the dry spinning process, the dynamic viscosity of an approximately 30 wt. % elastomer spinning solution with a composition corresponding to the above-mentioned specification DE 42 22 772, example 4, is 121 Pa.s at 50° C. Such a highly concentrated and comparatively highly viscous elastane solution is normally completely unsuitable for the wet spinning process. If such an elastane solution is used as spinning solution, filament tearing occurs constantly in the coagulation bath in the region of the spinneret after a short start-up phase. If, on the other hand, an approximately 22 wt. % elastane solution of the same composition having a spinning viscosity of approx. 34 Pa.s at 50° C. is used, a perfect spinning process is obtained.

An important condition for obtaining perfect elastane fibres from elastane spinning solutions is the long-term stability of the spinning solution in terms of its viscosity. As can be ascertained from the U.S. Pat. No. 5,288,779 (compare page 1, column 1, line 22 to 26), variations in the spinning viscosity lead to a whole series of disadvantages during the production of elastane filaments. As a result of different tensions of the filaments, difficulties arise in the winding process and a lack of uniformity in various other filament properties. All said disadvantages are prevented by starting with stable-viscosity spinning solutions.

The object of the present invention is to provide highly concentrated, stable-viscosity elastane spinning solutions with an elastane content of 30 wt. % and above and with a dynamic viscosity suitable for the wet spinning process of e.g. approx. 15 to 25 Pa.s, measured at 70° C., and a viscosity particularly suitable for the dry spinning process of 10 to 350 Pa.s, measured at 50° C. Due to the markedly increased solids concentration of the elastomer solution with the same dynamic viscosity compared with well known wet spinning elastane solutions of 20 to 25 wt. %, a markedly higher throughput of polymer material per unit of time and hence a marked increase in efficiency of the wet spinning process and, ultimately, of the dry spinning process are achieved.

Surprisingly, it was found that elastane solutions can be modified in terms of their viscosity and, in particular, that spinning solution concentrations of 30 wt. % elastane and above suitable for an elastane wet spinning process can be achieved with a conventional spinning viscosity for the wet spinning process when a secondary aliphatic amine, particularly an amine of $C_1$–$C_4$ aliphatics such as e.g. diethylamine (DEA) is added to highly concentrated elastane solutions with a content of at least 30 wt. % elastane, based on the spinning solution, and is allowed to react for a particular time at a temperature of at least 20° C., and is subsequently brought to a process temperature of 20 to 80° C. Depending on the quantity of amine added, the reaction temperature and the residence time, it is possible to adjust practically any lower spinning viscosity starting from the viscosity of the elastane solution used, with the result that the spinning solution obtainable from the process is suitable both for the dry and for the wet spinning process for the production of elastane filaments. In preference, the dynamic viscosity of the elastane spinning solution may be adjusted to 10 to 350 Pa.s (measured at 50° C.) for use in the dry spinning process, and to 15 to 25 Pa.s (measured at 50° C.) for use in the wet spinning process.

Unless otherwise specifically mentioned, all the viscosity data relate to a measurement at a shear gradient of 7 $s^{-1}$ by means of a rotational viscometer.

Stable-viscosity elastane solutions in this case mean those solutions of which the dynamic viscosity changes by 10% or less over a period of 2 days.

Elastane spinning solutions prepared according to the process of the invention have a surprisingly stable viscosity over a period of at least 3 to 5 days. Even after 7 days, no increase in the spinning solution viscosity was observed in some cases (compare FIG. 1).

The invention also relates to the spinning solutions obtainable according to the process of the invention. They exhibit a variation in viscosity of at most ±5% after 24 hours and at most ±10% after 48 hours.

In general, an addition of preferably 0.2 to 1.0 wt. % of secondary amine, e.g. diethylamine, based on the polymer solids, to the elastane solution is completely sufficient for preparing stable-viscosity elastane spinning solutions in the desired viscosity range suitable for dry or wet spinning.

In practice, a secondary amine addition of 0.5 to 0.8 wt. % based on the elastane solids proportion and a reaction temperature of 120° to 160° C. and a reaction time of 1 to 20 minutes has proved to be a particularly suitable condition for a wet spinning process in order to adjust the desired spinning viscosity of 15 to 25 Pa.s (measured at 70° C.) e.g. for a 30 wt. % elastane starting solution.

The inherent viscosity ($\eta_i$) of elastanes, which provides information about the molecular mass and the polymer structure, hardly alters at all after a treatment with e.g. diethylamine. Similarly, very good filament data are obtained for the elastane filaments spun from the elastane solutions. In other words, only a breakdown of crosslinks between the polymer chains takes place without any substantial interference with the linear structure of the polymers. It is known from the literature (compare K. Kamide and H. Hanakata, Polymer International 31 (1993), page 131 to 143), that urethane groups in elastanes crosslink with isocyanates to form allophanates, and urea groups with isocyanates to form biuret compounds. The ureas in turn are produced inter alia in secondary reactions from isocyanates and the spinning solvent dimethylacetamide. H. Okuto (compare Makromolekulare Chemie 98 (1966), page 157) was able to show by NMR analyses that the allophanate and biuret secondary reactions can be completely reversed by means of aliphatic primary amines, such as e.g.

n-butylamine, even at room temperature. If the primary aliphatic amine n-butylamine is used instead of the secondary aliphatic amine diethylamine to obtain the desired spinning viscosity, a very substantial reduction of the inherent viscosity from approx. 1.24 to 0.71 is observed, i.e. considerable interference with the polymer structure of the elastane filaments takes place, which is why primary amines are not suitable in the process according to the invention. Similar findings are reached if e.g. the chain extender ethylenediamine is used instead of secondary aliphatic amines.

Apart from the preferred diethylamine, which may be used to terminate the chain in the conventional chain extending operation, practically all the secondary aliphatic monoamines are suitable for the preparation of highly concentrated, stable-viscosity elastane spinning solutions with a suitable spinning viscosity for the spinning process in question.

If, for example, dibutylamine (DBA) is used instead of diethylamine (DEA) under otherwise identical conditions with regard to quantity, temperature and residence time in elastane spinning solutions, a spinning viscosity that is approximately twice as high as in the case of DEA is obtained. The relatively low reduction in viscosity is presumably attributable to steric hindrance due to relatively long butyl side chains.

Whereas a very considerable reduction in viscosity with interference with the polymer structure takes place with primary, aliphatic amines, as explained above, aliphatic secondary monoamines surprisingly give only a viscosity-reducing reaction, the viscosity reached after cooling to a process temperature of 20° to 80° C. being almost completely stable over a period of more than 7 days, in contrast to the teaching of U.S. Pat. No. 5,288,779 (compare column 5, lines 22 to 23 and lines 27 to 28).

The addition of secondary monoamines, preferably of DEA to a finished, filtered, and in principle well known 30 wt. % elastane spinning solution with a chemical composition as described e.g. in the specification DE 4 222 772 takes place advantageously in the side stream from a DEA-containing stock preparation by means of a gear pump. The metering of the stock preparation is chosen such that the desired quantity, for example 0.8 wt. % of DEA, based on the elastane solids is introduced. The stock preparation contains preferably up to 80 wt. % of secondary amine, based on 100 wt. % elastane solids. The spinning solution is subsequently heated e.g. in a mixer which is fitted with static mixing components, in order to allow the mixture to react and to obtain the relatively low wet spinning viscosity required. The spinning solution is cooled, e.g. to 70° C. and fed directly to the spinnerets in the coagulation bath. The amine-containing stock preparation mentioned is prepared preferably in such a way that secondary amine is added to the concentrated elastane solution, for example a 30 wt. % elastane solution, in a ratio of 1 to 0.2 to 1 to 0.8 and stirred intensively in an agitated vessel for a period of e.g. 30 minutes at slightly elevated temperature, e.g. 40° C. The finished stock preparation, which may contain up to 80 wt. % of secondary amine, based on elastane solids, is then fed directly to the spinning solution in front of the mixer/heat exchanger by means of a fine gear pump, as stated.

In the case of an elastane dry spinning process with a high starting viscosity of e.g. 250 Pa.s (measured at 50° C.), the addition of the amine-containing stock preparation described may take place immediately behind a multi-stage nozzle reactor device for the spinning solution as described in DE-OS 4,222,772. The spinning solution is subsequently allowed to react in a mixer and heated e.g. to 120° C. for 3 minutes in order to obtain the relatively low dry spinning viscosity required. The spinning solution is then cooled again e.g. to 40° C. and fed directly to the spinnerets in the dry spinning cells. The viscosity of a spinning solution which is particularly suitable for the dry spinning process is typically approx. 100 Pa.s, measured at 40° C.

In the case of an elastane dry spinning process with a low starting viscosity of e.g. less than 100 Pa.s (measured at 40° C.), the addition of the amine-containing stock preparation described may take place in the same way e.g. immediately behind a multi-stage nozzle reactor device as mentioned above for the spinning solution, without any further heating taking place in a mixer. The spinning solution is then kept at approx. 40° C. and fed directly to the spinnerets in the dry spinning cells. The viscosity of the spinning solution which is particularly suitable for the dry spinning process was 85 Pa.s, measured at 40° C.

An important advantage achieved with the process according to the invention is that an increase in efficiency may be achieved in view of e.g. a greatly increased quantity throughput of elastane solids during spinning but without impairing the filament properties of the elastane filament obtained.

The elastane solutions suitable in principle for the process may contain polyurethanes or polyurethane ureas with both polyester and polyether soft segments. Similarly, the well known conventional additives for improving stability to light and chlorine, receptiveness to dyeing etc. may be used in the spinning solution. Elastane filaments that may be obtained from the spinning solution prepared according to the invention are in this case filaments comprising at least 85 wt. % segmented polyurethanes (polyurethane ureas).

Methods of measurement

The measured variables mentioned in the following examples were determined as follows:

The inherent viscosity ($\eta_i$) of the elastomers was determined in a dilute solution of 0.5 g/100 ml dimethylacetamide (DMAC) at 30° C. by determining the relative viscosity $\eta_r$ in comparison with the pure solvent and converted according to the formulae $$\eta_R = \frac{t_1}{t_o} \text{ and } \eta_i = \frac{\ln \eta_r}{C}$$

In the formulae $t_1$=throughput time in seconds of the polymer solution $t_o$=throughput time in seconds of the pure solvent c=concentration of the spinning solution.

The strength (in cN/dtex) and the elongation at maximum load (in %), hereinafter abbreviated to elongation, were determined in accordance with the standard DIN 53 815.

The following examples serve to explain the invention in more detail. Unless otherwise specified, parts and percentage data refer to weight.

EXAMPLE 1

A diethylamine-containing stock preparation was mixed in a side stream by means of a gear pump with a 30 wt. % elastane solution which was prepared according to example 4 of DE 42 22 772, had a spinning viscosity of 123 Pa.s measured at 50° C. and an inherent viscosity of 1.24 dl/g, and subsequently heated to 130° C. by means of a heated static mixer fitted with mixing components. The residence time in the mixer was approx. 11 minutes. The quantity of DEA-containing stock preparation metered in the side stream was such that the spinning solution in front of the mixer had a DEA content of 0.8 wt. % based on the elastane solids. The stock preparation was prepared in a separate vessel from 2 kg of 30 wt. % elastane spinning solution as described above by adding 480 g of diethylamine (DEA) whilst stirring for 30 minutes at 40° C. The spinning solution was then cooled to 70° C. and fed directly to a 22-hole spinneret in a DMAC-containing coagulation bath. The spinning viscosity in front of the spinneret was 21 Pa.s, measured at 70° C. The inherent viscosity was 1.22 dl/g. The filaments were drawn off at 80 m/min, coalesced, washed, fixed, prepared and wound on to a winding machine. The filaments obtained with a titre of 151 dtex had a filament strength of 0.93 cN/dtex and an elongation of 652%.

EXAMPLE 2

A DEA-containing stock preparation was mixed with a 35% elastane solution which was prepared according to example 5 of DE 42 22 772, had a spinning viscosity of 159 Pa.s measured at 50° C. and an inherent viscosity of 1.03 dl/g, as described in example 1, and heated for approx. 1 minute at 160° C. in a static mixer. The spinning solution was subsequently cooled to 70° C. and, as described in example 1, wet spun from a 22-hole spinneret. The spinning viscosity in front of the spinneret was 25 Pa.s, measured at 70° C. The inherent viscosity was 0.96 dl/g. The filaments were spun, drawn off, coalesced and after-treated as noted in example 1. The filaments obtained with a titre of 155 dtex had a filament strength of 0.91 cN/dtex and an elongation of 618%.

In table 1 below, the viscosity of the spinning solution measured in Pa.s at 70° C. is given for a 30% elastane spinning solution as described in example 1, which had been treated with two different diethylamine quantities at different temperatures and a different reaction time. The spinning solution was cooled in each case to 70° C. after the treatment and measured. Without the addition of DEA, the spinning solution after a 21.7 minute reaction time at 120° C. had a spinning viscosity of 341 Pa.s measured at 70° C., and after the same reaction time (21.7 minutes) at 130° C. had a spinning viscosity of 360 Pa.s at 70° C.

viscosity stability (±10%) and a storage time of the elastane solution of several days at 50° C.

In FIG. 1, the viscosity curve of a 30% elastane spinning solution obtained according to example 1 is determined over 172 hours. 0.8 wt. % of diethylamine based on the elastane solids was added to the elastane spinning solution and, in the case of suitability for a wet spinning process, treated for 10 minutes at 130° C. and cooled to 50° C. (see curve A). In the case of suitability for a dry spinning process (see curve B), the elastane spinning solution was heated to 120° C. for approx. 1 minute and then cooled to 50° C. The viscosity was measured in Pa.s at 50° C. As can be derived from both curves A and B of FIG. 1, a very high viscosity stability is achieved over a period of more than 7 days. The viscosity of the elastane spinning solution that is suitable for the dry spinning process thus alters by less than 5% within 24 hours from 53 to 52 Pa.s, and the viscosity of the elastane spinning solution for the wet spinning process likewise alters by less than 5% within 24 hours from 26 to 25 Pa.s. After 48 hours, the change in viscosity of both spinning solutions is less than 10%.

The viscosity measured in Pa.s (at 70° C.) for a 30% elastane spinning solution obtained according to example 1 but for various additions of aliphatic amines is shown in table 2. In each case, 0.5 wt. % of secondary amine, based on elastane solids, is added to the spinning solution. The treatment time was 30 minutes and the treatment temperature was 120° C. The inherent viscosity, which is a measure of the change in the polymer structure, was also determined.

As can be seen from table 2, the desired wet spinning viscosity is achieved initially only with diethylamine. When dibutylamine (DBA) is used, larger quantities and a greater reaction temperature and reaction time are required. Presumably, steric hindrance due to relatively long butyl side groups is present in DBA. If the primary monomer n-butylamine is used instead of a secondary aliphatic monoamine, a very substantial reduction in viscosity occurs.

TABLE 1

Viscosities of elastane spinning solutions (Pa · s/70° C.)

| | Addition of DEA | | | | | | | | | | | |
|---|---|---|---|---|---|---|---|---|---|---|---|---|
| | 0.5 Treatment time (min) | | | | | | 0.8 Treatment time (min) | | | | | |
| Treatment temperature (°C.) | 0.9 | 2.7 | 3.6 | 7.7 | 10.8 | 21.7 | 0.9 | 2.7 | 3.6 | 7.7 | 10.8 | 21.7 |
| 120 | 50 | 48 | 42 | 35 | 30 | 26 | 53 | 48 | 41 | 35 | 29 | 25 |
| 130 | 45 | 42 | 35 | 28 | 23 | 20 | 46 | 39 | 32 | 25 | 21 | 17 |
| 140 | 39 | 36 | 30 | 23 | 19 | 16 | 40 | 31 | 22 | 17 | 15 | 13 |
| 150 | 33 | 31 | 25 | 19 | 15 | 12 | 34 | 24 | 16 | 11 | 9 | 8 |
| 160 | 28 | 25 | 19 | 14 | 11 | 8 | 26 | 18 | 12 | 7 | 5 | 4 |

As can be seen from table 1, the spinning viscosity of 15 to 25 Pa.s (measured at 70° C.) particularly suitable for a wet spinning process is obtained at a temperature of 120 to 60° C. and a reaction time of 1 to approx. 22 minutes. The higher the reaction temperature, the shorter the treatment time, as would be expected. The spinning viscosity of e.g. 5 to 53 Pa.s (measured at 70° C.) suitable for a dry spinning process is obtained by a heat treatment from 120 to 130° C. and a residence time of approx. 1 minute, with simultaneous As the inherent viscosity decreases very considerably at the same time, interference with the polymer structure is evidently taking place. If an elastane solution pretreated in such a way is spun, filaments of lower strength are indeed obtained. For example, a filament strength of only 0.55 cN/dtex was obtained for, elastane filaments prepared according to example 1 using n-butylamine instead of DEA, with a titre of 155 dtex. The elongation was only 553%.

TABLE 2

Viscosities of elastane spinning solutions for various amine additions
Spinning solution concentration = 30%, amine addition = 0.5 wt. %, based on elastane solids;
Treatment = 30 minutes/120° C.; cooling to 70° C.

| Amine | Spinning viscosity Pa · s/70° C. | Inherent viscosity (dl/g) |
|---|---|---|
| Diethylamine (DEA) | 21 | 1.22 |
| Dibutylamine (DBA) | 39 | 1.23 |
| n-Butylamine (nBA) | 5 | 0.71 |
| Without | 344 | 1.26 |

We claim:

1. A process for adjusting the viscosity of highly concentrated elastane solutions for the dry or wet spinning of elastane fibres from elastane solutions, characterised in that 0.2 to 1 wt. % of a secondary aliphatic amine, based on a 100 wt. % polyurethane content, are added to an elastane solution of polyester- or polyetherurethanes (urethane ureas) with a polyurethane content of at least 30 wt. % in order to reduce their viscosity, allowed to react at a temperature of at least 20° C. for a period of 1 to 60 minutes and subsequently brought to a process temperature of 20° to 80° C. for the spinning process.

2. A process according to claim 1, characterised in that 0.5 to 0.8 wt. % of secondary aliphatic amine based on 100% polyurethane (urethane urea) are used.

3. A process according to claim 1 characterised in that the secondary amine used is a dimethyl-, diethyl-, dipropyl- or dibutylamine.

4. A process according to claim 1 characterised in that the secondary amine is diethylamine.

5. A process according to claim 1 characterised in that the secondary amine is allowed to react with the elastane solution at a temperature of 120° to 160° C. for 1 to 20 minutes.

6. A process according to claim 1 characterised in that the addition of the secondary amine is prepared in the form of a highly concentrated stock preparation of the elastane solution and the amine and metered in a side stream by means of a pump in front of a heat exchanger designed to obtain the reaction temperature, the stock preparation containing up to 80 wt. % of secondary amine, based on 100 wt. % elastane solids.

7. A process according to claim 1 characterised in that the elastane solution has a solids content of at least 30 wt. % preferably 35 wt. % and above.

* * * * *

UNITED STATES PATENT AND TRADEMARK OFFICE

CERTIFICATE OF CORRECTION

PATENT NO. : 5, 741, 867

DATED : April 21, 1998

INVENTOR(S) : Reinehr, et al.

It is certified that error appears in the above-indentified patent and that said Letters Patent is hereby corrected as shown below:

On the title page, item [22] Filed: delete "Jan. 10, 1996" and substitute --July 10, 1996--

Signed and Sealed this

Twenty-sixth Day of October, 1999

*Attest:*

Q. TODD DICKINSON

*Attesting Officer*

*Acting Commissioner of Patents and Trademarks*